US008598971B2

(12) United States Patent
Yamada et al.

(10) Patent No.: US 8,598,971 B2
(45) Date of Patent: Dec. 3, 2013

(54) MAGNETIC FIELD CONTROL APPARATUS AND DIPOLE MAGNET

(75) Inventors: Takahiro Yamada, Hitachi (JP); Fumiaki Noda, Hitachi (JP)

(73) Assignee: Hitachi, Ltd., Tokyo (JP)

( * ) Notice: Subject to any disclaimer, the term of this patent is extended or adjusted under 35 U.S.C. 154(b) by 184 days.

(21) Appl. No.: 13/304,958

(22) Filed: Nov. 28, 2011

(65) Prior Publication Data

US 2012/0133305 A1 May 31, 2012

(30) Foreign Application Priority Data

Nov. 30, 2010 (JP) ..... 2010-265899

(51) Int. Cl.
*H05H 15/00* (2006.01)
*H01F 7/00* (2006.01)
*H01F 3/12* (2006.01)

(52) U.S. Cl.
USPC ..... 335/211; 315/503

(58) Field of Classification Search
USPC ..... 335/211; 313/440; 315/503
See application file for complete search history.

(56) References Cited

U.S. PATENT DOCUMENTS

| | | | | | |
|---|---|---|---|---|---|
| 2,531,028 | A | * | 11/1950 | Christofilos et al. | 315/503 |
| 2,567,904 | A | * | 9/1951 | Christofilos | 315/503 |
| 4,047,068 | A | * | 9/1977 | Ress et al. | 313/359.1 |
| 4,386,331 | A | * | 5/1983 | Kohzuki et al. | 335/211 |
| 4,433,268 | A | * | 2/1984 | Arisato | 313/440 |
| 4,737,727 | A | * | 4/1988 | Yamada et al. | 315/503 |
| 4,972,519 | A | * | 11/1990 | Grote | 313/440 |
| 4,996,496 | A | * | 2/1991 | Kitamura et al. | 315/501 |
| 5,179,319 | A | * | 1/1993 | Iwasaki et al. | 313/440 |

FOREIGN PATENT DOCUMENTS

| | | | |
|---|---|---|---|
| JP | 3-190099 | A | 8/1991 |
| JP | 8-78200 | A | 3/1996 |

* cited by examiner

*Primary Examiner* — Alexander Talpalatski
(74) *Attorney, Agent, or Firm* — Mattingly & Malur, PC

(57) ABSTRACT

To provide a magnetic field control apparatus capable of reducing a width of a correcting plate. The magnetic field control apparatus includes a conductive vacuum duct 1 disposed between dipole magnet magnetic poles 3 and a conductive correcting plate 2. The correcting plate 2 is formed of a material having an electric conductivity higher than that of the vacuum duct 1. A plurality of conductive correcting plates 2 are disposed in each of four areas, the four areas being formed by dividing a cross section of a vacuum duct 1 extending perpendicularly to a direction in which a charged particle beam travels by a symmetrical surface having each of both magnetic poles of the dipole magnet defined as a mirror image and a plane which extends perpendicularly to the symmetrical surface and through which a center of gravity of the charged particle beam passes.

7 Claims, 7 Drawing Sheets

⊙ IS AN EDDY CURRENT FLOWING FORWARD FROM THE SHEET SURFACE

⊗ IS AN EDDY CURRENT FLOWING BACKWARD FROM THE SHEET SURFACE

⊙ IS AN EDDY CURRENT FLOWING FORWARD FROM THE SHEET SURFACE

⊗ IS AN EDDY CURRENT FLOWING BACKWARD FROM THE SHEET SURFACE

- - - - MAGNETIC FIELD GENERATED BY EDDY CURRENT INDUCED IN VACUUM DUCT

····· MAGNETIC FIELD GENERATED BY EDDY CURRENT INDUCED IN CORRECTING PLATE

——— COMBINED MAGNETIC FIELD

MAGNETIC FIELD CONTROL APPARATUS AND DIPOLE MAGNET

BACKGROUND OF THE INVENTION

1. Field of the Invention

The present invention relates, in general, to an apparatus used within a varying magnetic field and, in particular, to an apparatus used between magnetic poles of a magnet of a synchrotron.

2. Description of the Related Art

A synchrotron used in various fields including scientific researches, and medical and industrial applications, orbits and, at the same time, rapidly accelerates a charged particle beam injected from a pre-accelerator. The synchrotron typically includes an injection apparatus that injects the charged particle beam that have been preliminarily accelerated by the pre-accelerator, a dipole magnet that bends and moves the charged particle beam around a predetermined circular path, a quadrupole magnet that gives horizontal and vertical converging forces so as to prevent an orbiting beam from being widened, and an RF cavity that applies an RF acceleration voltage to the orbiting beam to thereby accelerate the orbiting beam to a predetermined level of energy.

In order to circulate the charged particle beam along a predetermined orbit at all times, the synchrotron intensifies the magnetic field generated by the dipole magnet in synchronism with the acceleration. Since the charged particle beam circulates in vacuum, the synchrotron includes a vacuum duct with an evacuated interior disposed between magnetic poles of the dipole magnet. If the vacuum duct is formed of a conductive substance, an induced electric field causes an eddy current to flow through the vacuum duct. The eddy current induced in the vacuum duct generates a new magnetic field in an area past which the charged particle beam moves. This magnetic field has varying intensities depending on the position at which the charged particle beam moves, which unsteadies circulation of the charged particle beam.

JP-08-78200-A discloses art in which a nonmagnetic correcting plate is disposed between magnetic poles of the dipole magnet to thereby flatten a magnetic field which an eddy current generates in an area past which the charged particle beam moves. JP-03-190099-A discloses art that prevents a distribution of a magnetic field generated in a vacuum duct from being disturbed by continuously increasing a thickness of a vacuum duct of a synchrotron from a central portion toward end faces.

SUMMARY OF THE INVENTION

With the dipole magnet described in JP-08-78200-A, because of the wide correcting plate, current density is large on end portions, so that a heat value may become high. The vacuum duct of the synchrotron described in JP-03-190099-A is made to be thick so as to flatten the magnetic field of the area past which the charged particle beam moves. This widens a spacing between the magnetic poles, which may increase load on a magnet power source.

To solve the foregoing problems, the present invention provides a plurality of conductive correcting plates disposed in each of four areas, the four areas being formed by dividing a cross section of a vacuum duct extending perpendicularly in a direction in which a charged particle beam travels with a symmetrical surface having each of both magnetic poles of a dipole magnet defined as a mirror image and a plane which extends perpendicularly to the symmetrical surface and through which a center of gravity of the charged particle beam passes.

In the present invention, the width of the correcting plate for flattening the magnetic field distribution can be reduced, which allows heat generated by the eddy current of the correcting plate to be reduced and a rate of increase in the spacing between the magnetic poles to be reduced.

DESCRIPTION OF THE PREFERRED EMBODIMENTS

First Embodiment

As a first embodiment of the present invention, a synchrotron will be exemplified that flattens a magnetic field distribution generated by eddy currents induced in conductive substances disposed between magnetic poles of a dipole magnet. The synchrotron includes a conductive vacuum duct 1, a dipole magnet that bends a charged particle beam to a predetermined direction and moves the charged particle beam around an orbit, and an accelerating device that accelerates the charged particle beam. The magnetic field of the dipole magnet is intensified as the charged particle beam is accelerated, so that an eddy current is generated in the conductive vacuum duct 1 disposed between magnetic poles 3 of the dipole magnet.

A method for controlling a magnetic field generated by the eddy current and an apparatus thereof (hereinafter referred to as a magnetic field control apparatus) according to a first embodiment of the present invention will be described below with reference to FIGS. 1 through 8.

Figure 1:
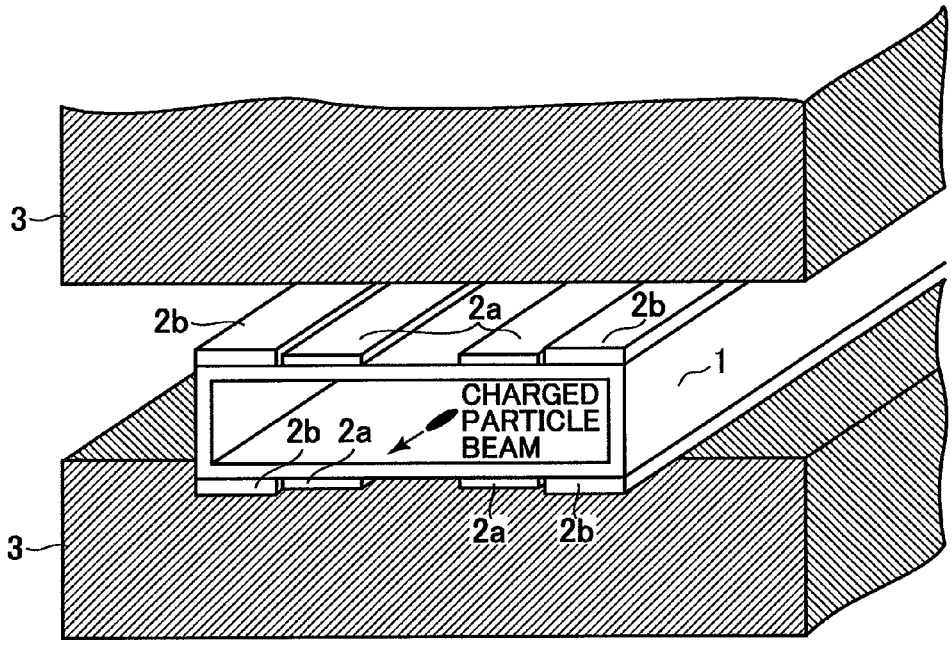
FIG. 1 is a conceptual diagram showing general arrangements of a magnetic field control apparatus according to a first embodiment of the present invention.

Arrangements of the magnetic field control apparatus according to the first embodiment of the present invention will be described with reference to FIG. 1. FIG. 1 is a conceptual diagram showing the arrangements of the magnetic field control apparatus according to the first embodiment of the present invention.

The magnetic field control apparatus according to the first embodiment of the present invention includes a plurality of conductive correcting plates 2 disposed on the conductive vacuum duct 1 placed between the dipole magnet magnetic poles 3. The conductive vacuum duct 1 as used herein means is a duct in which the eddy current is induced when the magnetic field generated by the dipole magnet changes with time, thereby disturbing the magnetic field in the area through which a beam passes. In the first embodiment of the present invention, the multiple correcting plates are disposed on an outer peripheral surface of the vacuum duct 1, which reduces a spatial change in the magnetic field arising from the eddy current induced in the vacuum duct 1, thereby flattening the magnetic field distribution. The correcting plates 2 are formed of a material having an electric resistivity lower than that of the vacuum duct 1. The correcting plates 2 are disposed such that a cross section of the vacuum duct 1 as viewed in a plane perpendicular to the charged particle beam is upper-lower and right-left symmetrical and multiple correcting plates 2 are disposed per quadrant. The term "right-left" as used herein means a direction extending in parallel with a magnetic pole surface and the term "upper-lower" as used herein means a direction extending perpendicularly to the magnetic pole surface. In the first embodiment of the present invention, two correcting plates 2 are disposed per quadrant. Nonetheless, the number of correcting plates 2 per quadrant may be more than two, or each quadrant may have a unique number of correcting plates 2. In addition, in the first embodiment of the present invention, an outer correcting plate 2*b* is thicker than an inner correcting plate 2*a*. A desired magnetic field distribution can be obtained by changing the width and the thickness of the correcting plate 2, and a position at which the correcting plate 2 is disposed. In this case, the correcting plates 2 may be disposed upper-lower and right-left asymmetrically. For a dipole magnet having magnetic pole surfaces that do not extend in parallel with each other, the correcting plates 2 are disposed symmetrically, in a vertical direction, relative to symmetrical surfaces having each of the magnetic poles defined as a mirror image.

Figure 2:
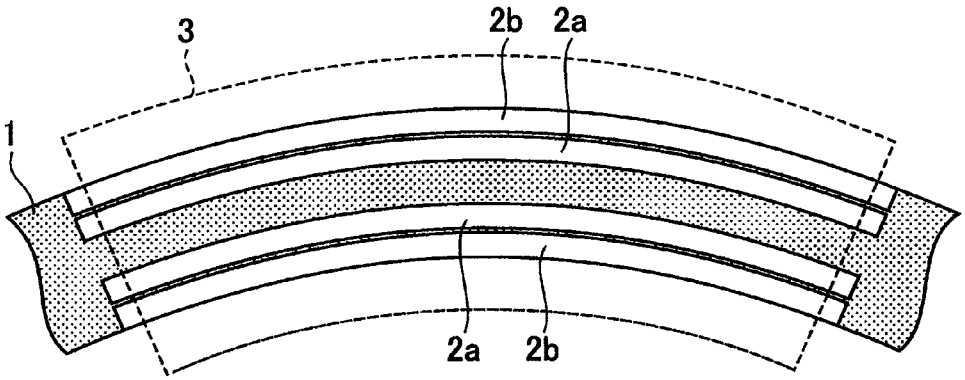
FIG. 2 is a plan view showing the magnetic field control apparatus according to the first embodiment of the present invention, as viewed from above.

FIG. 2 is a plan view showing the magnetic field control apparatus according to the first embodiment of the present invention. The correcting plates 2 are disposed on the outer peripheral surface of the vacuum duct 1 so as to follow along the shape of the vacuum duct 1, specifically, so as to have a constant cross-sectional shape.

Figure 3:
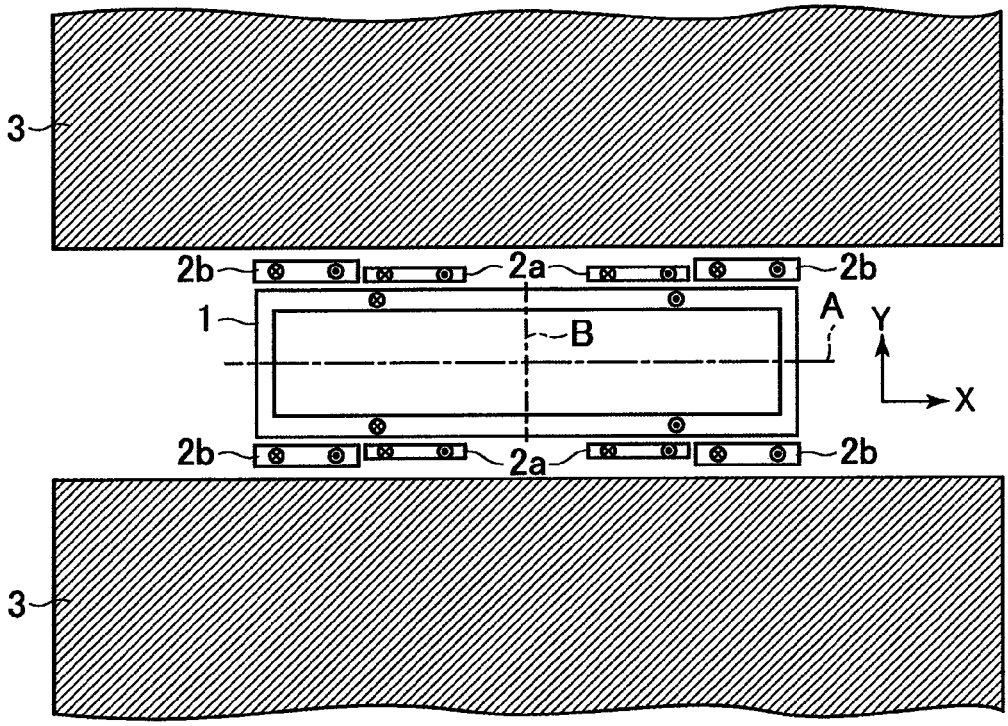
FIG. 3 is a cross-sectional view showing the magnetic field control apparatus according to the first embodiment of the present invention.

FIG. 3 is a cross-sectional view showing the magnetic field control apparatus according to the first embodiment of the present invention. In FIG. 3, the charged particle beam travels in a direction perpendicular to a sheet surface. A point of intersection between dash-single-dot lines A and B is here defined as the center of the vacuum duct 1. The dash-single-dot line A is a straight line along which the symmetrical surface having each of the magnetic poles of the dipole magnet defined as a mirror image intersects the sheet surface. Similarly, the dash-single-dot line B is a straight line along which a plane which extends perpendicularly to the symmetrical surface and through which a center of gravity of the charged particle beam passes intersects the sheet surface. The correcting plates 2 are disposed symmetrically with respect to the dash-single-dot lines A and B.

An axis which is parallel to the dash-single-dot line A is denoted as X and the right direction in FIG. 3 is defined as positive. Similarly, an axis which is parallel to the dash-single-dot line B is denoted as Y and the upper direction in FIG. 3 is defined as positive. The dipole magnet generates a magnetic field for bending the charged particle beam in a direction in which Y is positive. When the magnetic field for bending the charged particle beam intensifies with the accelerating charged particle beam, an electric field according to a change with time in the magnetic field is induced, so that an eddy current is induced in the vacuum duct 1 and the correcting plates 2. For the vacuum duct 1, the direction in which the eddy current flows is, as shown in FIG. 3, forward from the sheet surface in a direction in which X is positive as viewed from the center of the vacuum duct 1, while the direction in which the eddy current flows is backward from the sheet surface in a direction in which X is negative as viewed from the center of the vacuum duct 1. Similarly, for the correcting plates 2, the direction in which the eddy current flows is forward from the sheet surface in a direction in which X is positive as viewed from the center in the X direction of the correcting plates 2, while the direction in which the eddy current flows is backward from the sheet surface in a direction in which X is negative as viewed from the center in the X direction of the correcting plates 2.

Figure 4:
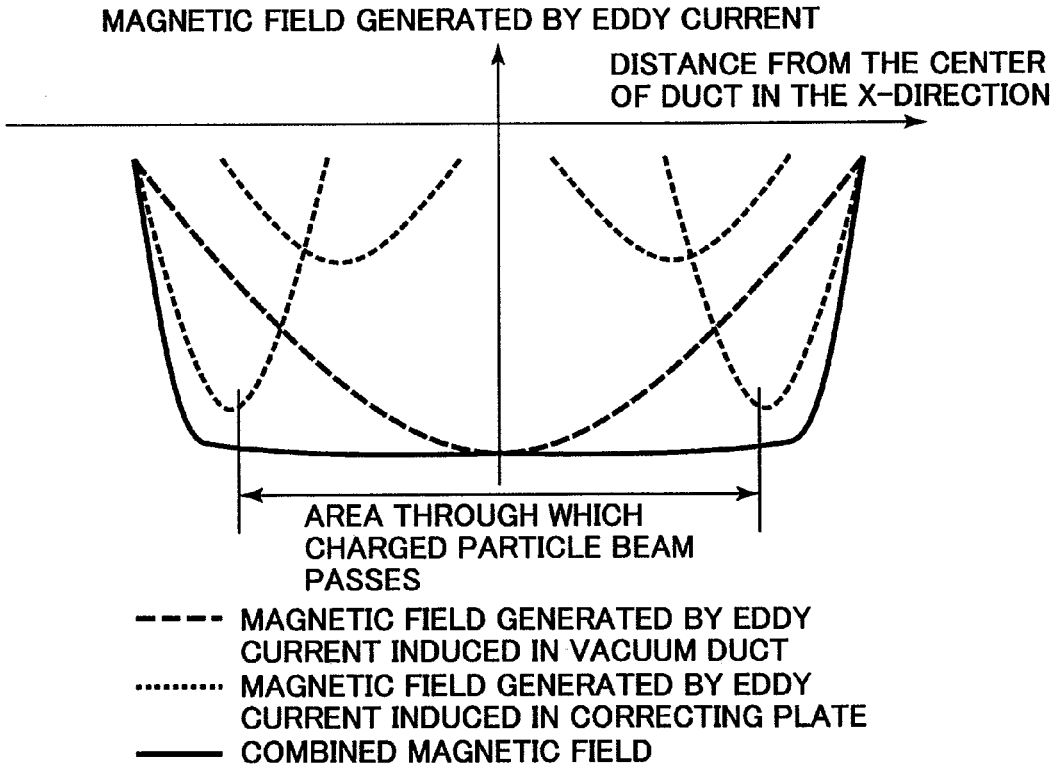
FIG. 4 is a conceptual diagram showing a magnetic field generated by an eddy current in the magnetic field control apparatus according to the first embodiment of the present invention.

The magnetic field generated by the eddy current in the area through which the charged particle beam passes will be described below with reference to FIG. 4. In FIG. 4, the positive direction of the magnetic field is the direction of the magnetic field for bending the charged particle beam, so that the eddy current generates a magnetic field in the negative direction. The eddy current induced in the vacuum duct 1 generates a magnetic field that is intense in an area near the duct center and weak toward the outside as indicated by a broken line. If such a magnetic field exists in the area through which the charged particle beam passes, a bending force varies according to the position at which the charged particle beam passes, so that a converging state of the charged particle beam changes and a loss of the charged particle beam may result. The eddy current induced in the correcting plates 2 generates a magnetic field as indicated by dotted lines. In the first embodiment of the present invention, the outer correcting plates 2*b* are thicker than the inner correcting plates 2*a*, so that the magnetic field generated by the eddy current induced in the outer correcting plates 2*b* is more intense than the magnetic field generated by the eddy current induced in the inner correcting plates 2*a*. By combining the magnetic field generated by the eddy current induced in the vacuum duct 1 with the magnetic field generated by the eddy current induced in the correcting plates 2, the magnetic field in the area through which the charged particle beam passes is flattened as indicated by a solid line in FIG. 4.

Figure 5:
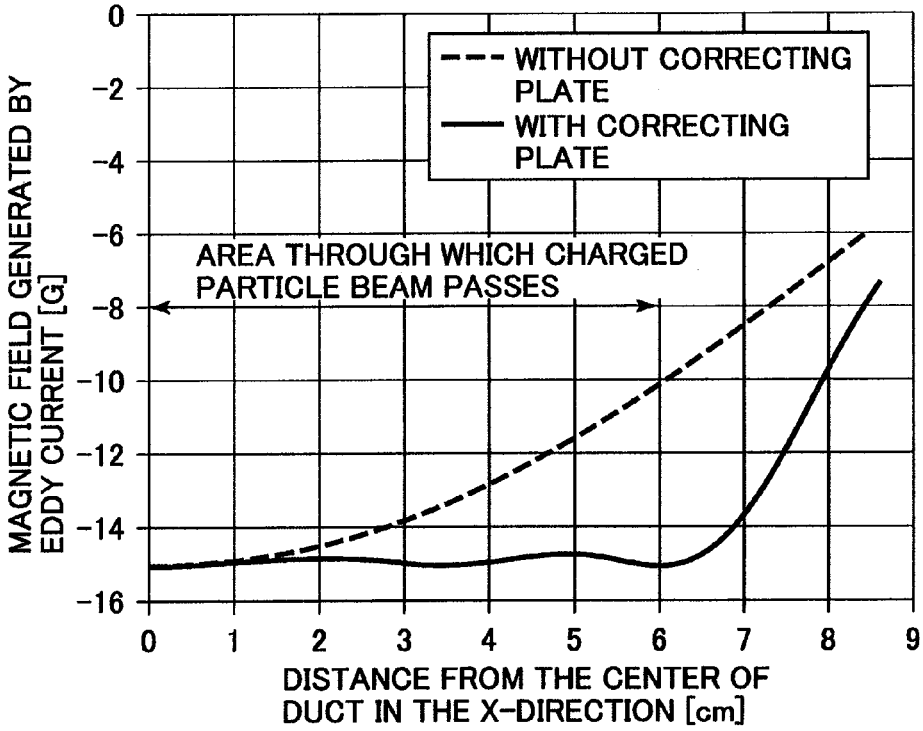
FIG. 5 is a graph showing calculations of the magnetic field generated by the eddy current in the magnetic field control apparatus according to the first embodiment of the present invention.

FIG. 5 shows calculations of a distribution of the magnetic field generated by the eddy current. As shown in FIG. 5, the magnetic field in the area through which the charged particle beam passes is flattened. It is noted that, in this calculation system, the inner correcting plates 2*a* have a width of 24 mm and the outer correcting plates 2*b* have a width of 30 mm.

Figure 6:
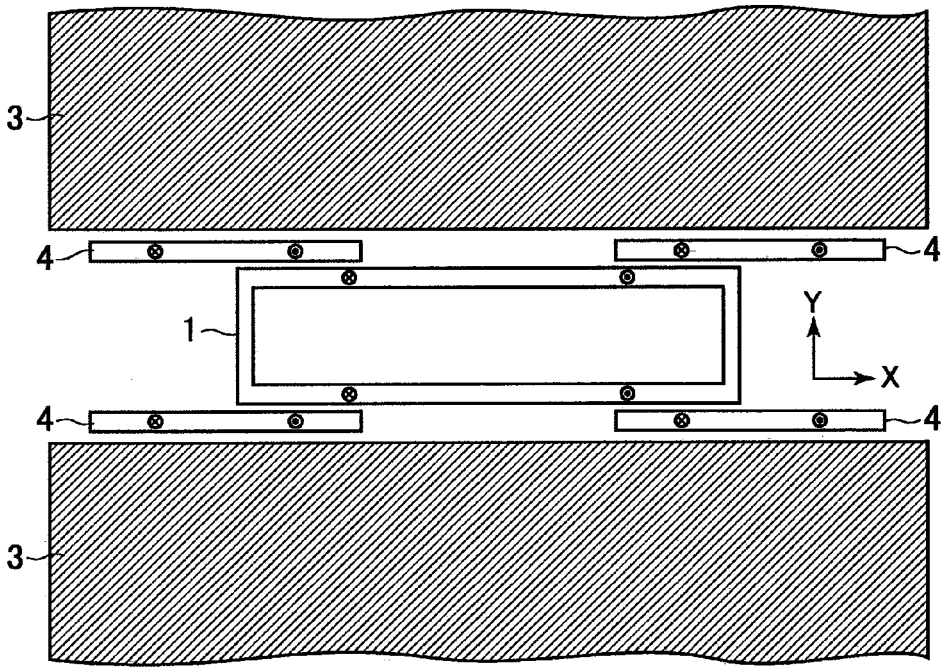
FIG. 6 is a cross-sectional view showing a magnetic field control apparatus according to prior invention 1.

FIG. 6 shows locations where correcting plates 4 in prior invention 1 (JP-A-08-78200) are disposed. As shown in FIG.

6, one correcting plate 4 having a wide width in the X direction is disposed per quadrant such that a cross section of the vacuum duct 1 as viewed on a plane perpendicular to the charged particle beam is upper-lower and right-left symmetrical. The direction of the magnetic field for bending the charged particle beam and the direction in which the eddy current flows are the same as those of the first embodiment of the present invention shown in FIG. 3.

Figure 7:
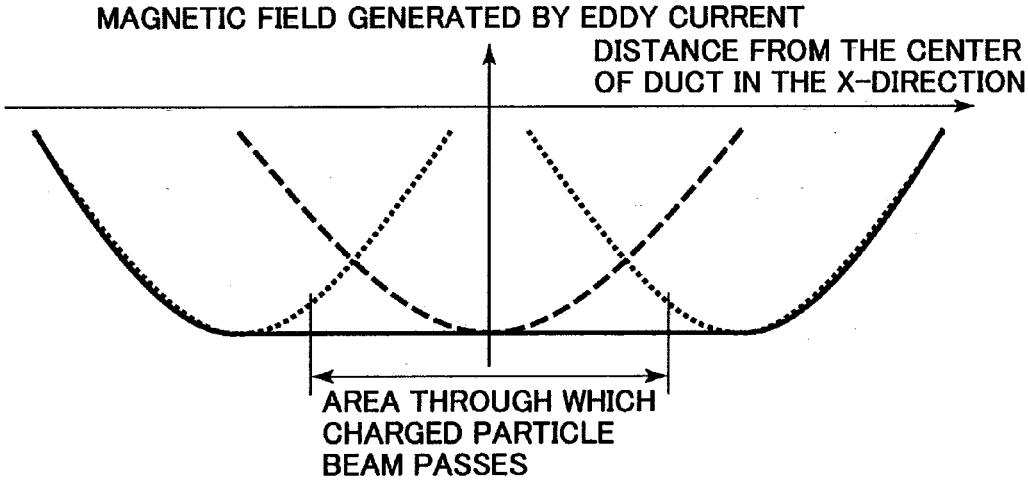
FIG. 7 is a conceptual diagram showing a magnetic field generated by the eddy current in the magnetic field control apparatus according to prior invention 1.

The magnetic field generated by the eddy current according to prior invention 1 will be described with reference to FIG. 7. In prior invention 1, the magnetic field in the area through which the charged particle beam passes is flattened by adding the wide magnetic fields (indicated by dotted lines) generated by the eddy current induced in the correcting plates 4 to both sides of the magnetic field (indicated by a broken line) generated by the eddy current induced in the vacuum duct 1.

Figure 8:
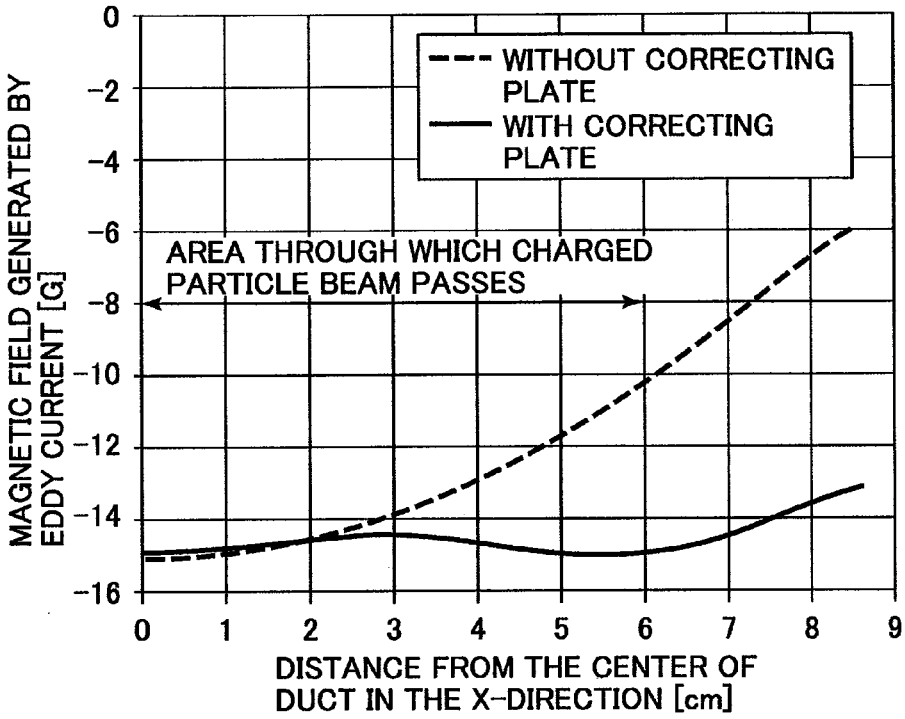
FIG. 8 is a graph showing calculations of the magnetic field generated by the eddy current in the magnetic field control apparatus according to prior invention 1.

FIG. 8 shows calculations of a distribution of the magnetic field generated by the eddy current according to prior invention 1. The correcting plates 4 are required to have a wide width in order to generate a wide magnetic field and, in this calculation system, the correcting plates 4 have a width of 160 mm.

Figure 9:
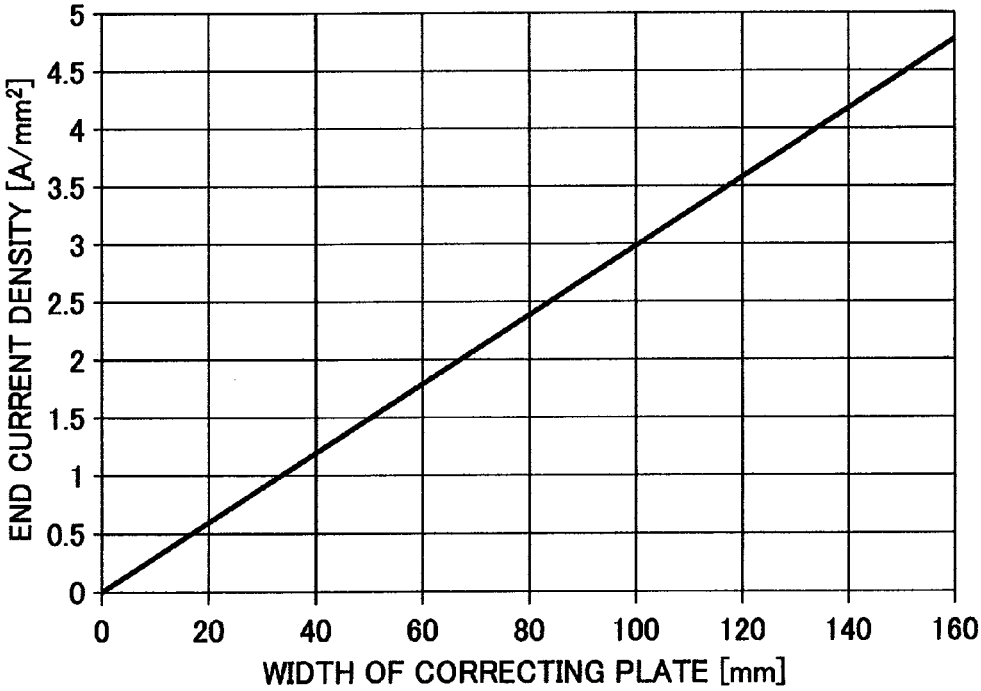
FIG. 9 is a graph showing density of an eddy current induced in an end portion of a conductive thin plate disposed within a time-varying magnetic field.

Generally speaking, density of the eddy current induced in a conductive thin plate disposed within a time-varying magnetic field is high in proportion to a distance from the center of the plate. As a result, the density of the eddy current induced in end portions of the correcting plate is high in proportion to the width of the correcting plate as shown in FIG. 9. The wider the width, the higher the current density at the end portions and the greater the heat value. If, for example, a copper having an extremely low electric resistivity is used for the correcting plate 4, the heat value involved is particularly large and, in prior invention 1, the correcting plate 4 is not applicable to a synchrotron having a high excitation speed. By reducing the width of the correcting plate according to the first embodiment of the present invention, the heat value produced by the eddy current can be reduced to thereby expand ranges of the excitation speed and of types of materials to be selected for the correcting plate, while maintaining an effect of magnetic field correction.

In prior invention 2 (JP-A-03-190099), on the other hand, the vacuum duct is made to be thick in order to achieve flattening. This results in a wider spacing between magnetic poles, which may increase load on a magnet power source (not shown). By using a material having an electric resistivity lower than that of the vacuum duct 1 for the correcting plate 2 according to the first embodiment of the present invention, a rate of increase in the spacing between the magnetic poles as a result of flattening can be reduced.

Second Embodiment

Figure 10:
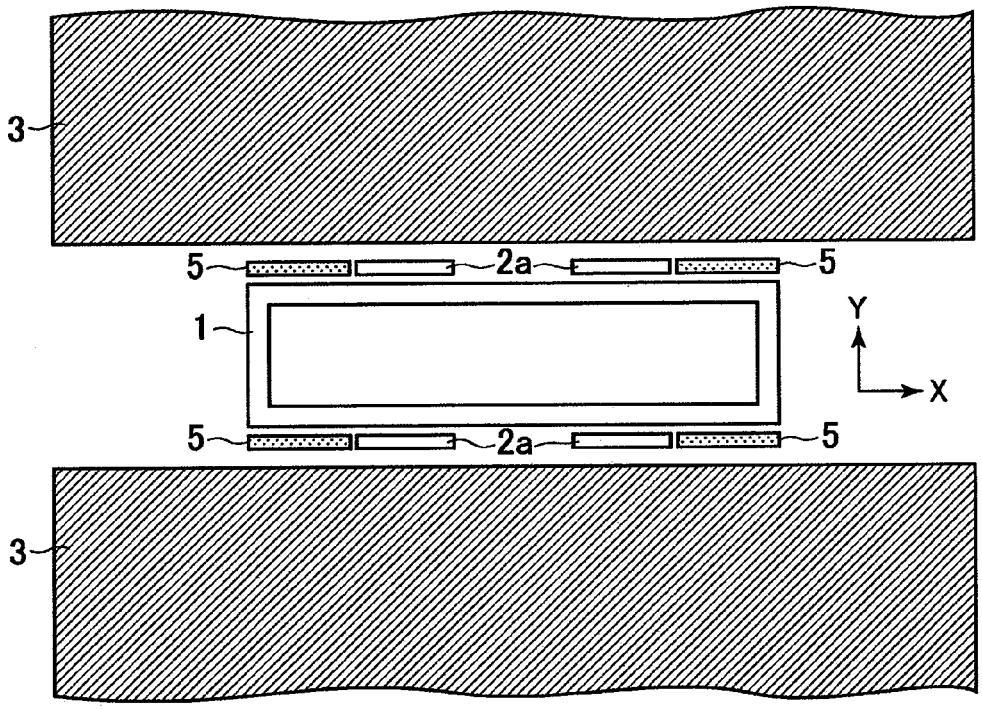
FIG. 10 is a cross-sectional view showing a magnetic field control apparatus according to a second embodiment of the present invention.

FIG. 10 is a cross-sectional view showing a magnetic field control apparatus according to a second embodiment of the present invention. Outer correcting plates 5 are formed of a material having an electric resistivity lower than inner correcting plates 2*a*. While an eddy current amount generated is controlled by forming the outer correcting plates 2*b* thicker than the inner correcting plates 2*a* in the first embodiment of the present invention, the eddy current amount to be generated can be controlled by using materials having different electric resistivity values as in the second embodiment.

Third Embodiment

Figure 11:
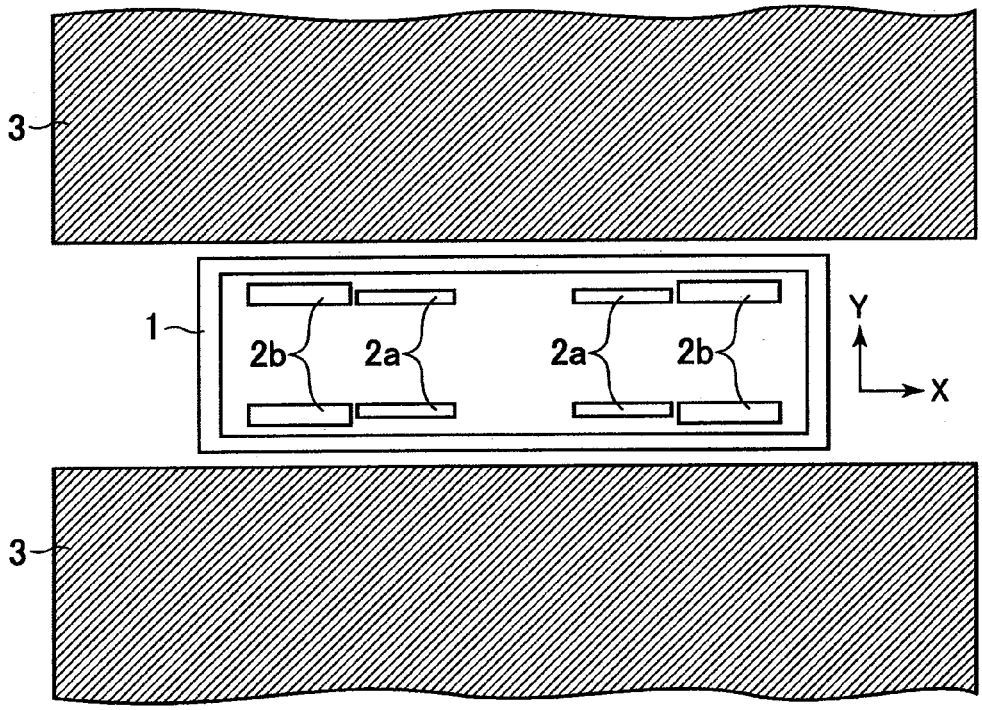
FIG. 11 is a cross-sectional view showing a magnetic field control apparatus according to a third embodiment of the present invention.

FIG. 11 is a cross-sectional view showing a magnetic field control apparatus according to a third embodiment of the present invention. In the first embodiment of the present invention, the correcting plates 2 are disposed on the outside (atmospheric side) of the vacuum duct 1. As in the third embodiment of the present invention, however, the magnetic field generated by the eddy current can also be controlled by disposing correcting plates 2 inside (vacuum side) a vacuum duct 1. It is noted that correcting plates 2*b* disposed on the outside may be replaced with the outer correcting plates 5 formed of a material having an electric resistivity lower than correcting plates 2*a* disposed on the inside.

Fourth Embodiment

Figure 12:
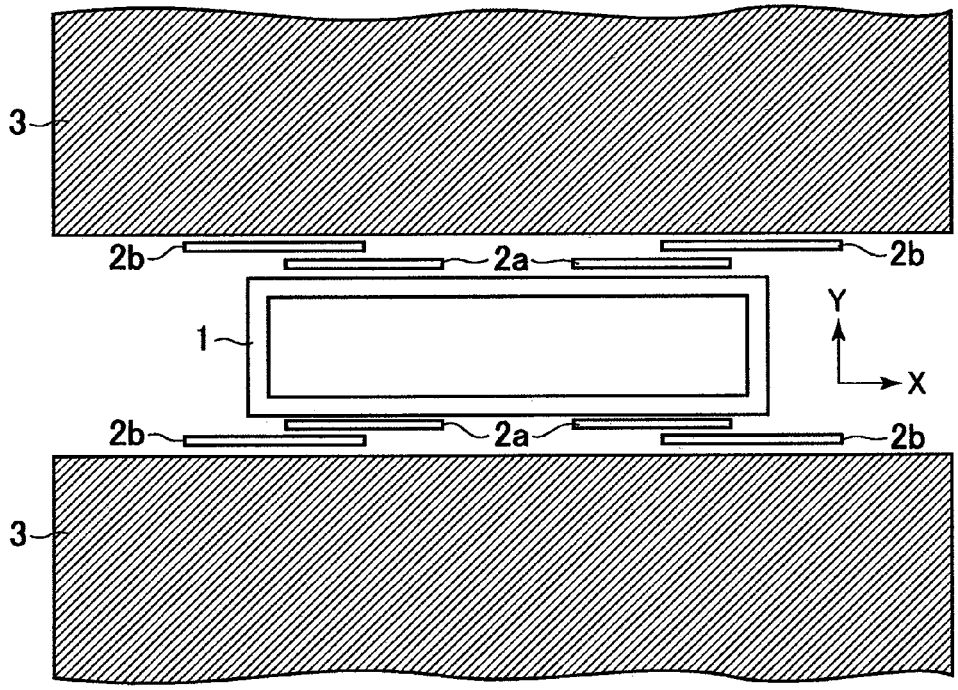
FIG. 12 is a cross-sectional view showing a magnetic field control apparatus according to a fourth embodiment of the present invention.

FIG. 12 is a cross-sectional view showing a magnetic field control apparatus according to a fourth embodiment of the present invention. In the first, second, and third embodiments, the correcting plates 2 are disposed without overlapping each other. However, by overlapping correcting plates 2 as in the fourth embodiment, the magnetic field generated by the eddy current can be controlled.

Fifth Embodiment

Figure 13:
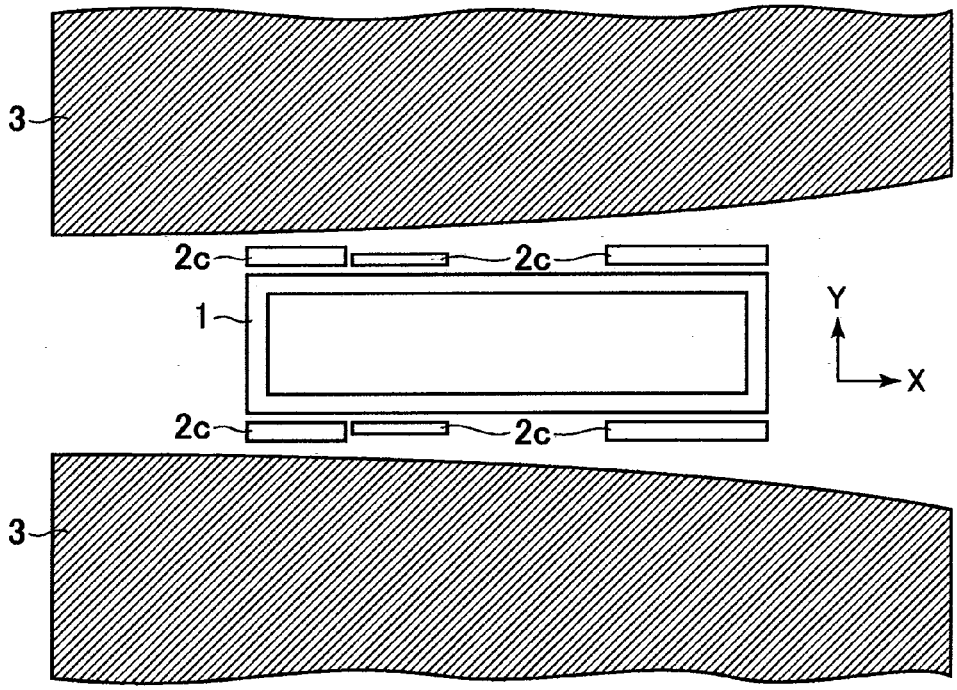
FIG. 13 is a cross-sectional view showing a magnetic field control apparatus according to a fifth embodiment of the present invention.

FIG. 13 is a cross-sectional view showing a magnetic field control apparatus according to a fifth embodiment of the present invention. In the first, second, third, and fourth embodiments, the correcting plates 2 are disposed right-left symmetrically. In the fifth embodiment, however, magnetic poles 3 are right-left asymmetrical as shown in FIG. 13. If the eddy current induced to correcting plates 2 varies according to the positions at which the correcting plates 2 are disposed in the X direction, the magnetic field generated by the eddy current can be controlled by disposing the correcting plates 2 right-left asymmetrically. In FIG. 13, the number and positions of the correcting plates 2 are asymmetrical, it is nonetheless effective to use correcting plates, each having a unique thickness or electric resistivity value.

Even if the magnetic poles 3 are not right-left asymmetrical, if the dipole magnet has a small bending radius and the eddy current induced to the correcting plates 2 varies according to the positions at which the correcting plate 2 are disposed in the X direction, the magnetic field generated by the eddy current can be controlled by disposing the correcting plates 2 right-left asymmetrically.

What is claimed is:

1. A magnetic field control apparatus comprising:

a conductive vacuum duct through which a charged particle beam passes; and a plurality of magnetic field correcting plates disposed on the vacuum duct in areas at which magnetic poles of a dipole magnet for bending the charged particle beam are disposed, wherein:

the magnetic field correcting plate is disposed for each of four areas defined by dividing a cross section of the vacuum duct, the cross section being perpendicular to a direction in which the charged particle beam travels, the cross section being divided by a symmetrical surface having each of both magnetic poles of the dipole magnet defined as a mirror image and a plane which extends perpendicularly to the symmetrical surface and through which a center of gravity of the charged particle beam passes, and at least one of the four areas of the vacuum duct includes a plurality of magnetic field correcting plates;

the magnetic field correcting plates are formed of a material having an electric resistivity lower than that of the vacuum duct; and a magnetic field in the vacuum duct is controlled by superimposing a magnetic field generated by an eddy current induced in the magnetic field correcting plates over a magnetic field generated by an eddy current of the vacuum duct.

2. The magnetic field control apparatus according to claim 1, wherein:

the magnetic field correcting plates are disposed symmetrically relative to the symmetrical surface having each of the magnetic poles of the dipole magnet defined as a mirror image.

3. The magnetic field control apparatus according to claim 1, wherein:

the magnetic field correcting plates are disposed symmetrically relative to the plane which extends perpendicularly to the symmetrical surface and through which a center of gravity of the charged particle beam passes.

4. The magnetic field control apparatus according to claim 1, wherein:

the magnetic field is controlled by disposing on the vacuum duct a plurality of the magnetic field correcting plates, each of the magnetic field correcting plates having a unique thickness different from the others.

5. The magnetic field control apparatus according to claim 1, wherein:

the magnetic field is controlled by disposing on the vacuum duct a plurality of types of the magnetic field correcting plates, each type of the magnetic field correcting plates having a unique electric resistivity different from the others.

6. The magnetic field control apparatus according to claim 1, wherein:

the magnetic field correcting plates are disposed on an inner surface portion of the vacuum duct.

7. The magnetic field control apparatus according to claim 1, wherein:

the magnetic field correcting plates are disposed in an overlapping manner.

* * * * *